United States Patent [19]

Hays

[11] Patent Number: 4,913,348

[45] Date of Patent: Apr. 3, 1990

[54] METHOD AND APPARATUS FOR CREATING CONTRASTING IMAGES AT SUBSTANTIALLY FULL CONTRAST VOLTAGE

[75] Inventor: Dan A. Hays, Fairport, N.Y.

[73] Assignee: Xerox Corporation, Stamford, Conn.

[21] Appl. No.: 288,319

[22] Filed: Dec. 22, 1988

[51] Int. Cl.[4] ..... G03G 15/08

[52] U.S. Cl. ..... 430/45; 355/246

[58] Field of Search ..... 355/244, 328, 246; 430/45, 127

[56] References Cited

U.S. PATENT DOCUMENTS

| | | | |
|---|---|---|---|
| 4,459,009 | 7/1984 | Hays et al. | 355/3 DD |
| 4,710,016 | 12/1987 | Watanabe | 355/4 |
| 4,731,634 | 3/1988 | Stark | 355/328 |
| 4,742,373 | 5/1988 | Nakatani | 355/14 R |
| 4,752,802 | 6/1988 | Ito et al. | 355/3 D |
| 4,754,301 | 6/1988 | Kasamura et al. | 355/3 DD |
| 4,811,046 | 3/1989 | May | 430/45 |

*Primary Examiner*—John L. Goodrow

[57] ABSTRACT

An electrostatic charge pattern is formed on a charge retentive surface. The charge pattern comprises charged image areas and discharged background areas. The fully charged image areas are at a voltage level of approximately −500 volts and the background is at a voltage level of approximately −100 volts. A spatial portion of the image area is used to form a first image with a narrow development zone while other spatial portions are used to form other images which are distinct from the first image in some physical property such as color or magnetic state. The development is rapidly turned on and off by a combination of AC and DC electrical switching. Thus, high spatial resolution multi-color development in the process direction can be obtained in a single pass of the charge retentive surface through the processing stations of a copying or printing apparatus. Also, since the voltages representing all images are at the same voltage polarity unipolar toner can be employed.

In order to effect development of all images with a unipolar toner, each of the development system structures is capable of selective actuation without physical movement.

6 Claims, 2 Drawing Sheets

METHOD AND APPARATUS FOR CREATING CONTRASTING IMAGES AT SUBSTANTIALLY FULL CONTRAST VOLTAGE

BACKGROUND OF THE INVENTION

This invention relates generally to highlight color imaging and more particularly to an image creation method and apparatus wherein contrasting images are formed by selectively developing an electrostatic image with colored or otherwise distinctive toners.

It is common practice to add information to the face of a document or to highlight certain portions of it by underlining. It is also common to delete portions of the document either by crossing out information or by covering it with a blank piece of paper. As will be appreciated, writing data or underlining on the document spoils the original document while writing data or underlining on the copies requires much labor when many copies are required. Moreover, it is sometimes difficult to write on copies due to the impregnation of the paper substrate with silicone oil used in the fusing of the images to the substrate. Recent developments in imaging systems have obviated the foregoing problems by the provision of methods and apparatus to reproduce an altered copy of the original document, as well as an identical copy thereof. Thus, recent innovations printing machines provide for reproducing a document without unwanted information of the original document, and with the addition of new data thereto. In this way, the machine performs an editing function which significantly reduces the labor and time in preparing revised copies from the original document. Another editing function relates to highlighting an area of a document to be copied or printed in a color different from the rest of the document.

The latent image of an original document, formed by scanning the original document and projecting a light image thereof onto the charged portion of the photoconductive surface so as to selectively discharge the charge thereon, may be altered in various ways. The latent image may be edited by superimposing thereover an electrically modulated beam, such as a modulated laser beam, or the like. The modulated laser beam adds additional information or erases information from the scanned latent image. In this way, the resultant copy is altered from the original document. Various techniques have been devised for transmitting an electrical signal to modulate the laser so that the desired information is recorded on the latent image. The latent image may also be altered by selective actuation of light emitting diodes which are positioned perpendicular to the process direction of the printing machine.

The Panasonic E2S copier system uses an electronic pad to edit, move or delete information on a copy, and the Panasonic electronic print board allows information recorded on a blackboard sized electronic board to be copied automatically by a copying machine on a copy sheet. In order to define the area that is to be altered, the coordinates of the relevant information on the original document to be modified must be transmitted to the printing machine.

The NP 3525 and Color Laser Copier manufactured by the Canon Corporation employs an edit pad which enables selected portions of a copy to be deleted. The NP 3525 and Color Laser Copier edit pad also permits color highlighting of designated areas of the document.

The formation of image areas to be highlighted is disclosed in U.S. Pat. No. 4,742,373. Highlighting in accordance with the disclosure of this patent is effected by using an editing pad to designate x,y coordinate values of information to be highlighted. The output from the editing pad is utilized to vary the intensity of a bank of light emitting diodes (LEDS) positioned perpendicular to the process direction of a charge retentive surface. Thus, for highlighting certain information of the original document, the LEDS are operated at half intensity. While the disclosure of this patent appears to be silent as to the actual method of developing such an image, it is customary to use two developer housings containing different color developers for this purpose which develop the electrostatic image at substantially less than the full contrast voltage.

For the purpose of creating optimum quality highlight color images, it is desirable to use a scavengeless development system, at least in the second of the two developer housings employed. A scavengeless development system is one where the developer has minimal interaction with the toned images already formed on the charged retentive surface. Optimally, it would be advantageous if all interaction of developers with the image receiver could be avoided. A scavengeless development system is disclosed in U.S. patent application Ser. No. 171,062 filed Mar. 21, 1988 and assigned to the same assignee as this application As described therein, toner is liberated from a donor roll by the application of an AC voltage to wires spaced from the donor roll by the toner thickness thereon. A DC bias applied across the gap between the donor roll and an image receiver controls development of the latent image by the liberated toner.

U.S. Pat. Nos. 4,710,016 and 4,754,301 disclose an imaging apparatus which utilizes two colored developer housings which are adapted to be selectively moved between development and non-development positions relative to the charge retentive surface.

U.S. Pat. No. 4,752,802 illustrates a magnetic brush development system designed so that toner or developer can be withdrawn from the development zone without having to move the developer housing away from the charge retentive surface as required in the '301 patent. Two developer units are employed and are selectively used for each copying operation by the operator manipulating a selector switch provided on a control panel. At least one developing unit of the two component magnetic brush type is disposed opposite an electrostatic latent image receiver. The developing units have a developing sleeve in which is housed a magnetic core assembly that can be oriented by a drive means to switch development on and off by controlling the height of the developer in the development zone and the amount of developer metered onto the roll. The rotatable developing sleeve is turned on and off simultaneously with the magnet orientation to switch development on and off, respectively. For development, the magnetic core assembly is so rotated that a weak magnetic or non-magnetic portion is at a position opposite to a level regulating member, and a high magnetic field is at a position opposite to the electrostatic latent image carrier. Furthermore, the rotating sleeve is stopped when development is switched off. Thus, to switch off development a developing powder present on the outer periphery of the developing sleeve is shunted away from the developing zone and the sleeve rotation stopped. Such shunting of the developing powder is carried out with any of the developing units other than one selected for developing. Since development is obtained with a strong magnetic field in a zone adjacent to the electrostatic latent image carrier, the transitional width for switching color development is bbs8 mm. This implies that information separated by less than 8 mm in the process direction cannot be color separated by this process.

U.S. patent application Ser. No. 78,743 filed on July 28, 1987 and assigned to the same assignee as this application discloses a tri-level image development system comprising two developer housings, each containing at least two magnetic brush developer rolls. The developer rolls in one of the housings are adapted to be reverse rotated for the purpose of removing toner material from the development zone formed by the two rolls and a charge retentive surface.

BRIEF SUMMARY OF THE INVENTION

Briefly, in practicing the present invention, an electrostatic charge pattern is formed on a charge retentive surface. The charge pattern comprises charged image areas and discharged background area. The fully charged image areas are at a voltage level of approximately −500 volts and the background image areas are at a voltage level of approximately −100 volts. A spatial portion of the image area is used for developing a first image with a narrow development zone while other spatial portions are used for developing other images which are distinct from each other in some physical property such as color or magnetic state as with Magnetic Ink Character Recognition, (MICR) toner. Thus, unlike prior art in highlight color imaging, high spatial resolution multi-color development in the process direction can be obtained in a single pass of the charge retentive surface through the processing stations of a printing apparatus. Also, since the voltages representing all images are at the same voltage polarity, unipolar toner can be employed and pretransfer charging is unnecessary.

In order to effect development of all images with a unipolar toner, each of the development system structures is capable of selective actuation without physical movement. The development is rapidly turned on and off by a combination of AC and DC electrical switching.

Actuation of each development system structure at the appropriate spatial place on a document structure is accomplished in accordance with information programmed into an Electronic Subsystem (ESS). Alternatively, actuation of each developer structure can be accomplished in accordance with information received from an input device such as an edit pad. The edit pad can be used to designate areas of a document which are to be developed in highlighting colors. Electrical signals representing the location of the highlight information is used to control the actuation of the development system structure at the appropriate time interval for developing that information.

DETAILED DESCRIPTION OF THE PREFERRED EMBODIMENT OF THE INVENTION

Figure 1:
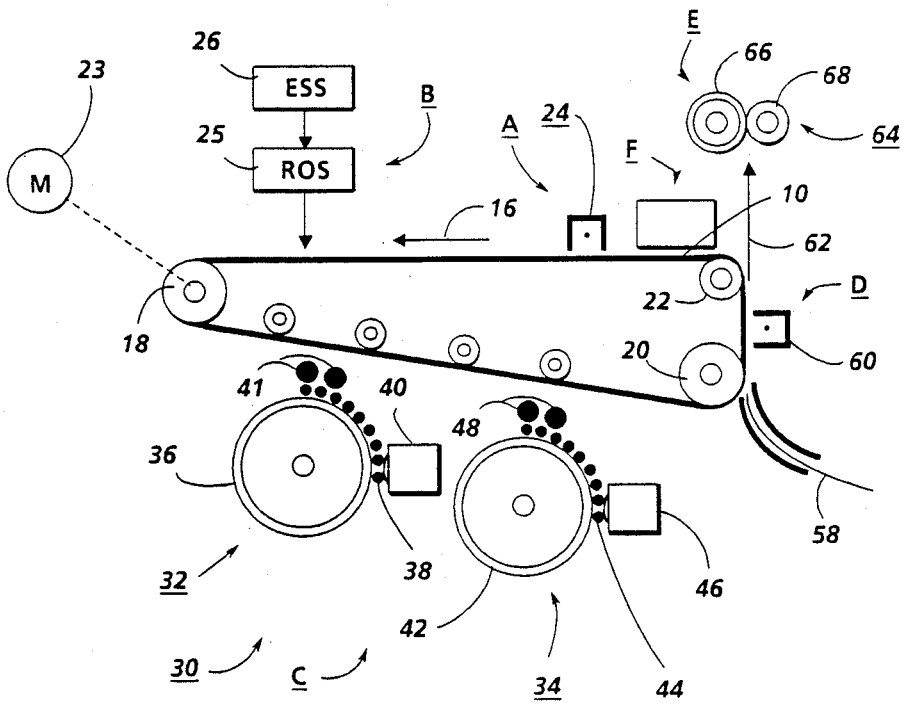
FIG. 1 is schematic illustration of a printing apparatus incorporating the development system features of our invention.

As shown in FIG. 1, a printing machine incorporating the invention may utilize a charge retentive member in the form of a photoconductive belt 10 consisting of a photoconductive surface and an electrically conductive substrate and mounted for movement past a charging station A, imaging station B, developer station C, transfer station D and cleaning station E. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of the arrow 16. Roller 18 is coupled to motor 23 by suitable means such as a belt drive.

As can be seen by further reference to FIG. 1, successive portions of belt 10 pass through charging station A. At charging station A, a corona discharge device such as a scorotron, corotron or dicorotron indicated generally by the reference numeral 24 charges the belt 10 to a selectively high uniform positive or negative potential, $V_0$. Preferably charging is negative. Any suitable control, well known in the art, may be employed for controlling the corona charging device 24.

Next, the charged portions of the photoreceptor surface are advanced through exposure station B. At exposure station B, the uniformly charged photoreceptor or charge retentive surface 10 can be exposed to light from either an illuminated document imaged through a lens or digitally modulated light source such as a scanning laser or light emitting diode array. The imagewise light exposure causes the uniformly charged surface to be modified in accordance with the desired electrostatic image. For illustrative purposes, a two level (i.e. full-on or full-off) laser Raster Output Scanner (ROS) 25 is disclosed.

For the laser ROS exposure system, the full-on state of the ROS corresponds to image information and the full-off state to background information. Thus, the areas exposed to the ROS output contain discharged areas which correspond to background areas and charged areas which correspond to image areas. The charged image voltage is approximately −500 volts while the background voltage level is approximately −100 volts. A computer program stored in an Electronic Subsystem (ESS) 26 generates digital information signals for operating the ROS.

At development station C, a development system, indicated generally by the reference numeral 30, advances developer materials into development zones. The development system 30 comprises first and second development system apparatuses 32 and 34. The development system 32 comprises a donor structure in the form of a roller 36. The donor structure 36 conveys a toner layer to the development zone. The toner layer can be formed on the donor 36 by either a two component developer or single component toner 38 deposited on 36 via a combination single component toner metering and charging device 40. The development zone consists of an AC biased electrode structure 41 self-spaced from the donor roll 36 by the toner layer 38. The single component toner as illustrated in FIG. 1 comprises positive black toner. The donor roller 36 is preferably coated with TEFLON-S (trademark of E.I. DuPont De Nemours) loaded with carbon black.

For single component toner, the combination metering and charging device 40 may comprise any suitable device for depositing a monolayer of well charged toner onto the donor structure 36. For example, it may comprise an apparatus such as described in U.S. Pat. No. 4,459,009 wherein the contact between weakly charged toner particles and a triboelectrically active coating contained on a charging roller results in well charged toner. Other combination metering and charging devices may be employed. For donor roll loading with two component developer, a conventional magnetic brush can be used for depositing the toner layer onto the donor structure.

The developer apparatus 32 further comprises an electrode structure 41 which is disposed in the space between the charge retentive surface 10 and the donor structure 36. The electrode structure is comprised of one or more thin (i.e. 50 to 100μ diameter) tungsten wires which are lightly positioned against the donor structure 36. The distance between the wires and the donor is self-spaced by the thickness of the toner layer which is approximately 25μ. The extremities of the wires are supported by end blocks at points slightly below a tangent to the donor roll surface. Mounting the wires in such manner makes the self-spacing insensitive to roll runout.

The second developer apparatus 34 is similar to the first apparatus 32. FIG. 1 shows the donor structure 42 conveying single component developer 44 deposited thereon via a combination metering and charging device 46 to an electrode structure 48 in a second development zone. The single component toner in this case comprises positive red toner. The donor structure can be rotated in either the 'with' or 'against' direction vis-a-vis the direction of motion of the charge retentive surface.

Figure 2:
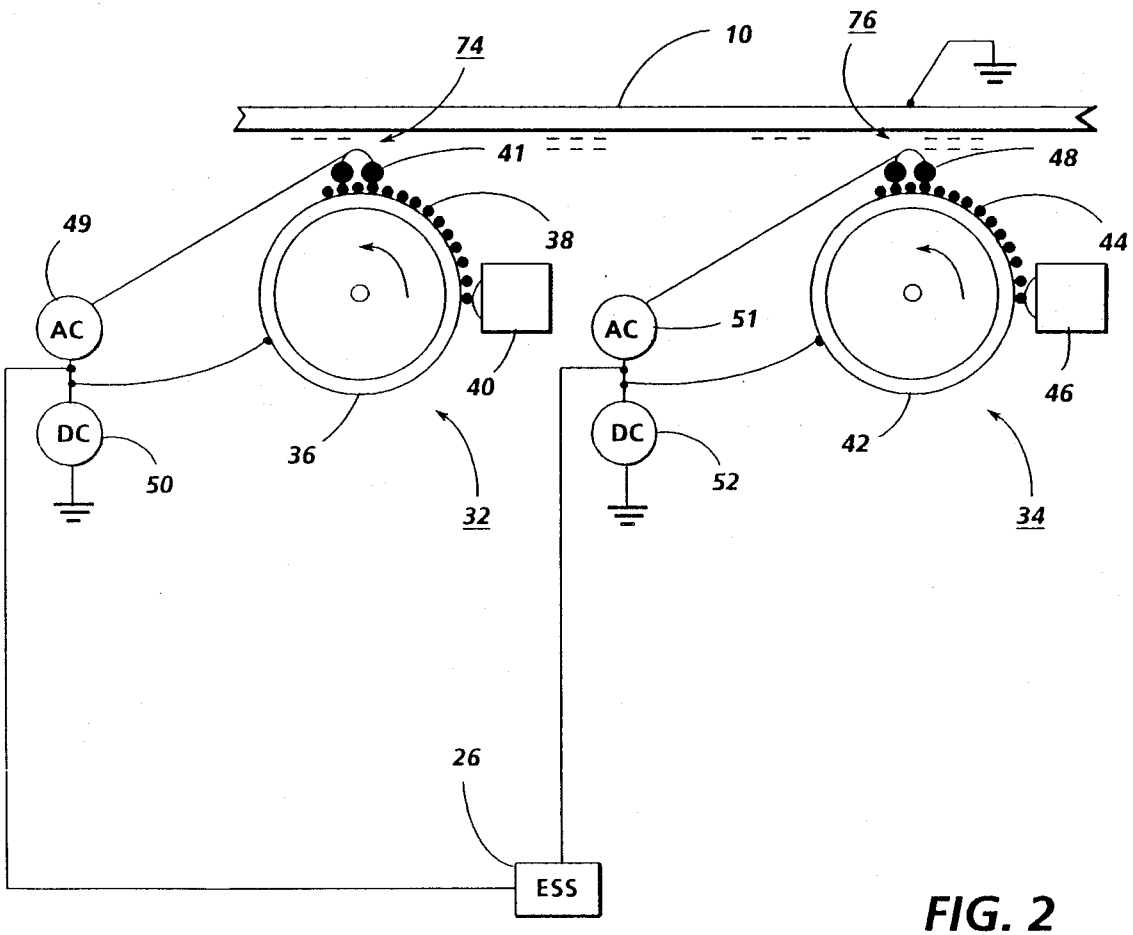
FIG. 2 is a schematic illustration of a pair of development structures employed in the printing apparatus of FIG. 1.

As illustrated in FIG. 2, an alternating electrical bias is applied to the electrode structure 41 via an AC voltage source 49. The applied AC establishes an alternating electrostatic field between the wires and the donor structure which is effective in detaching toner from the surface of the donor structure and forming a toner cloud about the wires, the height of the cloud being such as not to contact with the charge retentive surface. The magnitude of the AC voltage is relatively low and is in the order of 200 to 300 volts peak at a frequency of about 4 kHz up to 10 kHz. A DC bias supply 50 applies a voltage to the donor structure 42 which establishes an electrostatic field between the charge retentive surface of the photoreceptor 10 and the donor structure for the purpose of providing an electric field to suppress toner deposition in the discharged area latent image on the charge retentive surface and attracting the detached toner particles form the cloud surrounding the wires 41 to the charged area images. A dc bias of approximately −200 volts is used for the development of charged area images.

As illustrated in FIG. 2, a similar alternating electrical bias is applied to the electrode structure 48 via an AC voltage source 51. The applied AC establishes an alternating electrostatic field between the wires and the donor structure which is effective in detaching toner from the surface of the donor structure and forming a toner cloud about the wires, the height of the cloud being such as not to contact with the charge retentive surface. The magnitude of the AC voltage is relatively low and is in the order of 200 to 300 volts peak at a frequency of about 4 kHz up to 10 kHz. A DC bias supply 52 applies a voltage to the donor structure 42 which establishes an electrostatic field between the charge retentive surface of the photoreceptor 10 and the donor structure for the purpose of providing an electric field to suppress toner deposition in the discharged areas on the charge retentive surface and attracting the detached toner particles from the cloud surrounding the wires 48 to the charged area images. A dc bias of approximately −200 volts is used.

At a spacing of approximately 25μ between the electrode structure and donor structure an applied AC voltage of 200 to 300 volts peak produces a relatively large electrostatic field without risk of air breakdown. The use of a dielectric coating on either of the structures helps to prevent shorting of the applied AC voltage. The maximum field strength produced is in the order of 8 to 12 volts/μ. While the AC bias is illustrated as being applied to the electrode structure it could equally as well be applied to the donor structure.

Referring now to FIG. 1, a sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

The ESS 26 is operatively coupled to the AC power supplies 49 and 51 and DC power supplies 50 and 52 for the purpose of rapidly switching development on and off. The ESS provides electrical signals to the power supplies when certain images are present in a development zones 74 and 76.

It will be appreciated that, in the case of a copying machine, the power supply switching could be set by a sliding indicator on a platen. To rapidly switch on development with the donor roll structure rotating, the AC is applied with 100 to 300 volts peak and the DC is set at a level to control background deposition with the minimum electric field. To rapidly switch off development, the AC is turned off and the DC is set at a level which suppresses toner deposition even in the charged image areas. A DC level shift to −600 volts is necessary since mechanical disturbance of the toner layer by the self-spaced wire structures can cause some toner deposition in the charged image areas unless the DC electric field is in the sense to prevent the dislodged toner from depositing in the image areas. Simultaneously with the switching of the AC and DC biases to turn off development, the rotation of the donor roll structure is stopped. Even though it takes some time for the donor roll structure to come to a complete stop, the development is rapidly switched off by the fast AC and DC bias shifts. For a single AC biased 50μ wire structure, the transition width for switching from one color to another can be as narrow as 0.5 mm. For two AC biased wire structures, the transition width is less than 1 mm. This represents a substantial improvement over the present disclosed practice.

The detailed discussion of the preferred embodiment described herein has entailed a description of two different resident development systems which contain toner with different physical properties such as color or magnetic character. It is intended that a multiplicity of resident development systems could be included to provide a wide selection of color and magnetic toners for coloring many different image areas in a single pass process. The selection of colors would also be used to create new colors by depositing different colored toners in the same image area.

What is claimed is:

1. The method of creating contrasting images in a single pass, said method including the steps of:

uniformly charging a charge retentive surface;

forming an electrostatic latent image pattern on said charge retentive surface, said pattern comprising multiple image areas and background areas said multiple image areas being at the same voltage level;

moving said multiple images past at least two developer structures containing at least two distinct developer materials;

electrically biasing one of said at least two developer structures as one of said multiple images passes thereby whereby one of said multiple images is developed with one of said at least two distinctive developers;

electrically biasing another of said at least two developer structures as another of said multiple images passes thereby whereby said another of said multiple images is developed with another of said at least two distinctive developers;

removing the electrical bias from said one of said at least two developer structures as said another of said multiple images passes thereby whereby development thereof is precluded; and removing the electrical bias from said another of said at least two developer structures as said one of said multiple images passes thereby whereby development thereof is precluded.

2. The method according to claim 1 wherein each of said developer structures comprises:

a donor member for transporting toner particles from a supply to a development zone formed between said donor member and said charge retentive surface;

a plurality of electrode structures positioned in close proximity to each of said donor members; and further including an alternating voltage source operatively coupled to said electrode structures for effecting liberation of toner particles from said donor members and a DC voltage source for applying a bias between said electrode structures and said donor member.

3. The method according to claim 1 wherein said steps of removing said electrical bias include simultaneously switching said alternating and DC voltage sources between on and off states for effecting development of said multiple images or precluding development thereof.

4. The method according to claim 3 wherein said one and said another of said multiple image areas are developed with toner materials having the same polarity.

5. The method according to claim 4 wherein said one and said another of said multiple image areas are developed with toner materials having different color toners.

6. The method according to claim 5 wherein said one and said another of said multiple image areas are developed with toner materials having different magnetic states.

* * * * *